US009706895B2

(12) United States Patent
Ucar et al.

(10) Patent No.: US 9,706,895 B2
(45) Date of Patent: Jul. 18, 2017

(54) HOUSEHOLD APPLIANCE COMPRISING A BALANCING SYSTEM

(71) Applicant: ARCELIK ANONIM SIRKETI, Istanbul (TR)

(72) Inventors: Ali Egemen Ucar, Istanbul (TR); Uygar Unverdi, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 14/773,752

(22) PCT Filed: Mar. 4, 2014

(86) PCT No.: PCT/EP2014/054105

§ 371 (c)(1),
(2) Date: Sep. 8, 2015

(87) PCT Pub. No.: WO2014/135505

PCT Pub. Date: Sep. 12, 2014

(65) Prior Publication Data

US 2016/0029873 A1 Feb. 4, 2016

(30) Foreign Application Priority Data

Mar. 8, 2013 (TR) ..... a 2013/02840

(51) Int. Cl.
*A47L 15/42* (2006.01)
*E05F 1/10* (2006.01)
(Continued)

(52) U.S. Cl.
CPC ..... *A47L 15/4261* (2013.01); *E05D 11/1064* (2013.01); *E05D 13/10* (2013.01);
(Continued)

(58) Field of Classification Search
CPC ..... A47L 15/4261; E05Y 2900/304; E05Y 2900/308; E05Y 2201/626; E05F 1/1075; F24C 15/023; E05D 13/1207
See application file for complete search history.

(56) References Cited

U.S. PATENT DOCUMENTS 2,731,011 A * 1/1956 Maier ..... F24C 15/023 126/191
3,046,974 A * 7/1962 Kimberley ..... F24C 15/023 126/191

(Continued)

FOREIGN PATENT DOCUMENTS

DE 1879157 U 9/1963
DE 102009014023 B3 8/2010

OTHER PUBLICATIONS

International search report and written opinion for WO2014/135505 and references cited herein.

*Primary Examiner* — Justin Rephann
(74) *Attorney, Agent, or Firm* — Kilpatrick Townsend & Stockton LLP

(57) ABSTRACT

The present invention relates to a balancing system (50) that exerts force with different values to a door during the opening-closing stages and the household appliance (100) wherein the same is used. The different force values during opening/closing are obtained by the cable (3) in the balancing system (50) rubbing against the sections (9, 10) of the first spool (5)z with different physical properties.

18 Claims, 5 Drawing Sheets

Figure 1:
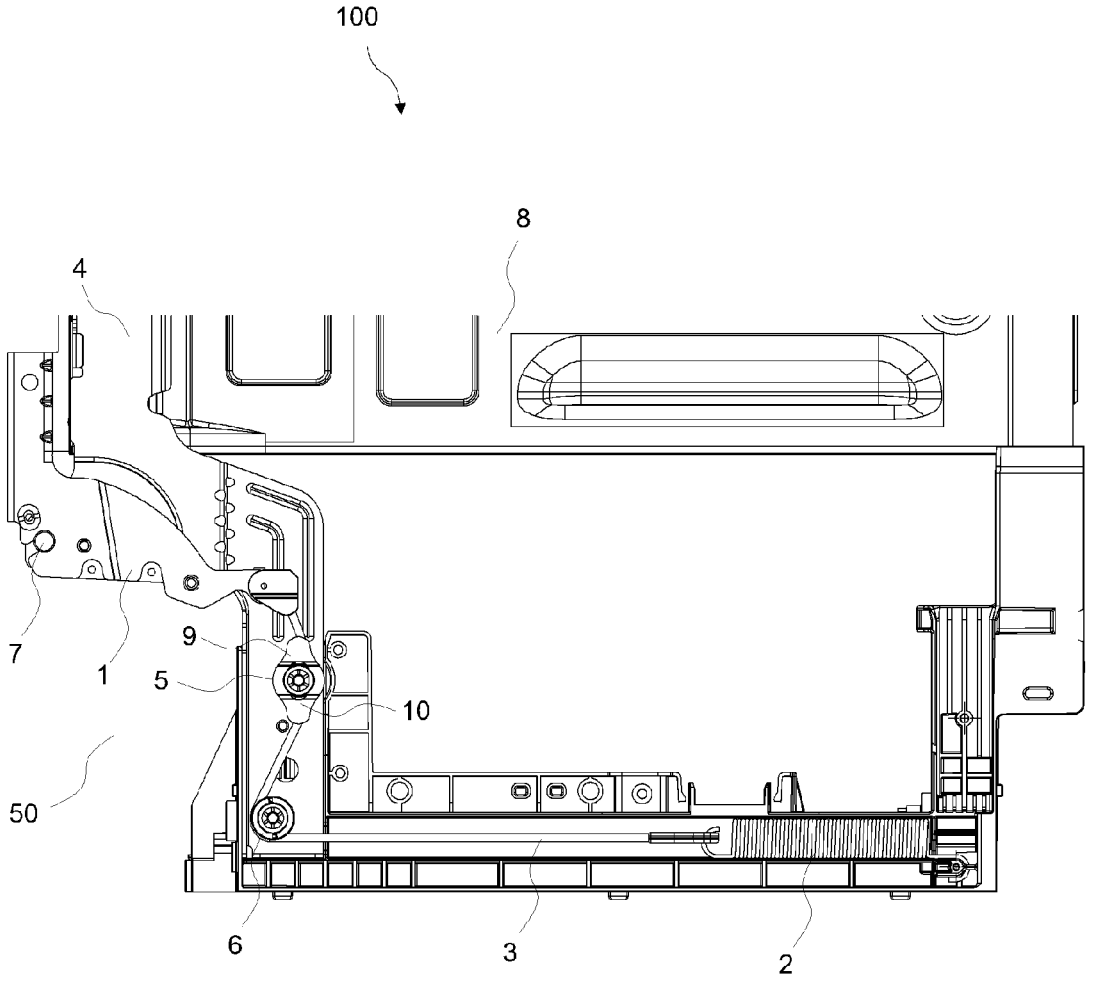

(51) Int. Cl.
*E05D 11/10* (2006.01)
*E05D 13/00* (2006.01)

(52) U.S. Cl.
CPC ..... *E05F 1/10* (2013.01); *E05F 1/1075* (2013.01); *E05Y 2201/654* (2013.01); *E05Y 2900/308* (2013.01)

(56) References Cited

U.S. PATENT DOCUMENTS 3,049,114 A * 8/1962 Carnahan ..... F24C 15/023 126/191
5,980,006 A * 11/1999 Wilhelmstatter ... A47L 15/4261 126/191
5,988,933 A * 11/1999 Wilhelmstatter ... A47L 15/4261 126/191
7,862,132 B2 * 1/2011 Tynes ..... A47L 15/4261 312/228
8,292,381 B2 * 10/2012 McDaniel ..... A47L 15/4261 312/319.2
8,297,768 B2 * 10/2012 Kara ..... A47L 15/4246 134/113
8,944,530 B2 * 2/2015 Haft ..... E05D 13/1207 312/228
2004/0113531 A1 6/2004 Raches
2008/0122331 A1 * 5/2008 Haeberle ..... A47L 15/4261 312/319.1
2009/0072686 A1 * 3/2009 Vooren ..... A47L 15/4261 312/319.4
2010/0051067 A1 * 3/2010 Dalsing ..... A47L 15/4261 134/46
2010/0225211 A1 9/2010 Kara et al.
2011/0074261 A1 * 3/2011 Assmann ..... A47L 15/4259 312/326
2011/0163643 A1 * 7/2011 Hotz ..... A47L 15/4261 312/228
2011/0215691 A1 9/2011 Keskin et al.
2011/0241507 A1 * 10/2011 Diebold ..... A47L 15/4261 312/228
2013/0063011 A1 * 3/2013 Kozinski ..... A47L 15/4261 312/319.2

* cited by examiner

HOUSEHOLD APPLIANCE COMPRISING A BALANCING SYSTEM

The present invention relates to a balancing system enabling the door of a household appliance to be balanced while being opened and closed and relates to the household appliance wherein the same is used.

In full and semi built-in dishwashers, a wooden panel matching the kitchen cabinet doors is mounted on the front surface of the product so that the machine is partially or fully concealed inside the kitchen and blends with the kitchen furniture. The said wooden panel is not mounted on the machine when the packaged dishwasher leaves the factory and is mounted on the machine afterwards by being prepared in a size suitable for the kitchen of the user. In dishwashers, balancing systems are used so that the door does not fall down abruptly while being opened due to the weight of the wooden panel and does not harm the users.

In the state of the art United States of America Patent Application No. US 2011/0215691 A1, a balancing system is explained, comprising a spring, a hinge arm attached to the door, a cable one end of which is connected to the hinge arm and the other end to the spring and which winds around a spool rotating around a fixed axis. In this balancing system, the spring that is attached to a cable mounted on the door provides the required force for balancing the door, and the spool around which the cable is wound both directs the cable to the desired direction and also decreases the effect of the forces acting on the door by the friction force it applies on the cable.

The spring in the balancing system of a great many state of the art products is positioned so as to function horizontally. In these products, the hinge arm is attached to the horizontally functioning spring by means of the cable passing over one or two spools. In this system, the friction force that decreases the effect of the door weight in the vertical direction is provided by the spools. Although, one of the spools being fixed and the other movable can solve the above mentioned problems but the shape of the fixing may cause other problems.

The aim of the present invention is the realization of a balancing system of simple configuration that enables the door to be opened and closed softly and to be stopped at every position safely and also the realization of a household appliance wherein the said balancing system is used.

The balancing system, realized in order to attain the aim of the present invention and explicated in the attached claims, is suitable for balancing the door of a household appliance and comprises a hinge plate fixed to the body of the household appliance, a hinge arm connected to the hinge plate so as to rotate around its horizontal axis and whereon the openable-closable door is mounted, a spring one end of which is fixed to the body and which exerts force on the door in the direction of closing, a cable one end of which is connected to the hinge arm and the other end to the free end of the spring, transferring force from the spring to the hinge arm, and a first spool that is fixed to the hinge plate or the body of the household appliance so as to rotate around its axis, that supports and directs the cable running thereover while the door being is opened/closed and that has two separate sections formed in different sizes and/or from different materials that rub against the cable.

The balancing system of the present invention can be used in all household appliances and pieces of furniture comprising openable-closable doors. The household appliance realized in order to attain the aim of the present invention and explicated in the attached claims, comprises the balancing system of the present invention. The balancing system of the present invention is preferred to be used in a dishwasher.

In the balancing system, friction can be differently exerted during the opening-closing stages by means of the spool of the present invention. The different force values during opening and closing becomes possible by the cable, that functions in the balancing system, rubbing against the sections of the spools having different physical properties, for example produced from different materials and/or having different sizes. It is possible to obtain sections with different physical properties by means of different designs. It is possible to differentiate friction, for example, by producing the sections of the spool that rub against the cable from materials with different coefficients of friction. Alternatively, different force values for opening-closing stages are obtained by differentiating the sizes of the spool sections rubbing against the cable. Different force values for opening-closing phases are obtained for example, by forming the spool sections rubbing against the cable with different lengths and/or positioning the sections at different distances from the rotational axis. Different force values are obtained during opening and closing of the door by the distances of the spool sections rubbing against the cable to the rotational axis being different from each other.

The spool in the balancing system is disposed rotatably on a bearing. The sections form the spool by preferably being aligned with the opposite sides of the bearing. The spool preferably has round protrusions that extend in opposite directions and is configured as a rhombus with rounded sides. In another embodiment of the present invention, the spool is elliptical. Thus, the spool is prevented from rotating a full tour during opening-closing. Alternatively, the rotation of the spool can be limited with a stopper. In the situation the stopper is used, the spool can be produced from materials having different coefficients of friction in two half circles forming a complete circle. The spool of the present invention preferably forms a single piece structure. The balancing system furthermore comprises an additional spool over which the cable runs.

In the embodiment of the present invention, the cable in the balancing system rubs against the lower section of the spool of the present invention while the door is opened and rubs against the upper section of the spool of the present invention while the door is closed. The spool of the present invention makes rotational movements in opposite directions with angles smaller than 90 degrees, without rotating completely around its axis while the door is opened/closed and enables the cable to rub against the spool by changing to the fixed position. The balancing system provides separate force values for opening and closing positions of the door, and a greater friction force is obtained through the lower section of the spool, thus it becomes possible to balance variable wooden panel weights in the built-in dishwashers and to stop the door at any position while opening. Furthermore, the door of the dishwasher is enabled to be closed easily by maintaining less friction through the upper section of the spool.

The model embodiments relating to the balancing system and the dishwasher wherein the same is used, realized in order to attain the aim of the present invention, are illustrated in the attached figures, where:

FIG. 1—is the partial view of a dishwasher and a balancing system when the door of the dishwasher is closed.

Figure 2:
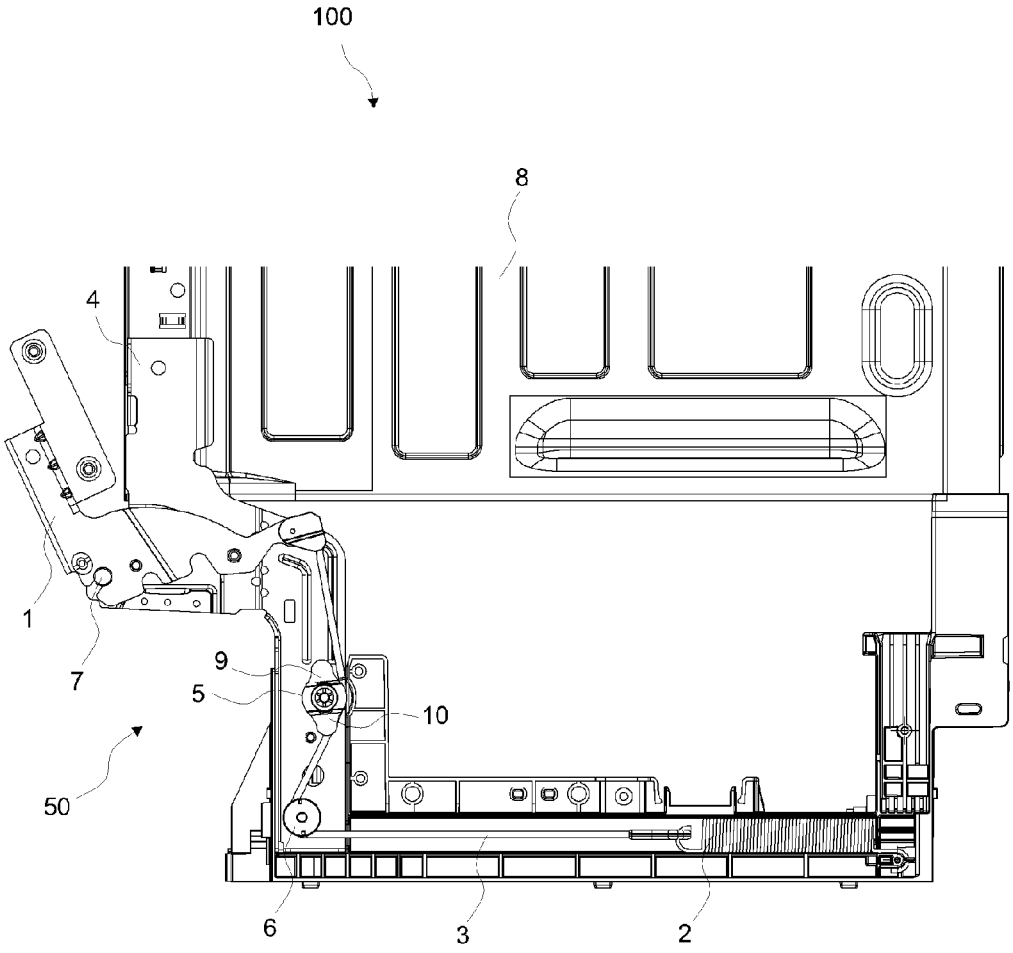

FIG. 2—is the partial view of a dishwasher and a balancing system when the door of the dishwasher is open.

Figure 3:
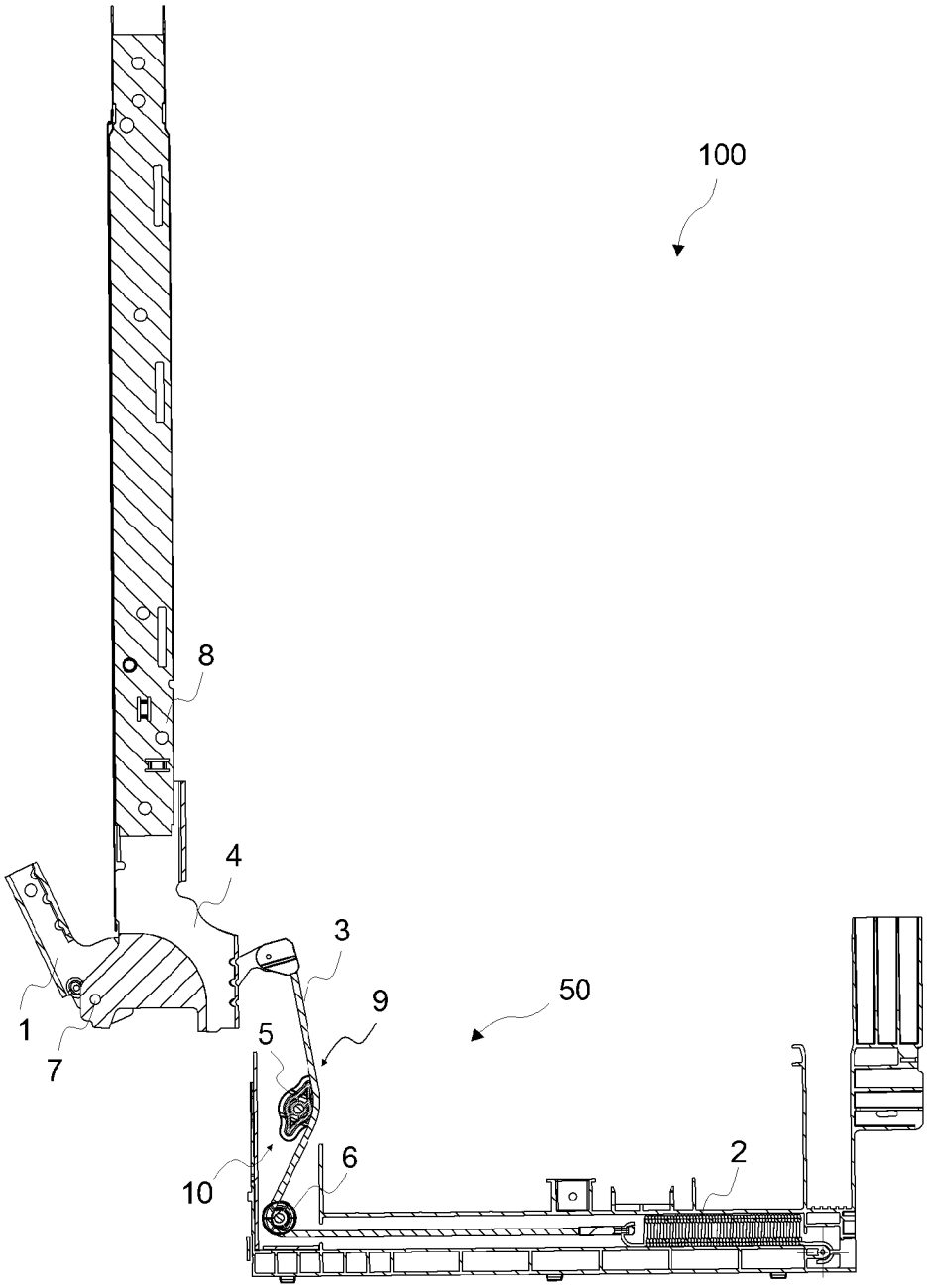

FIG. 3—is the cross-sectional view of a dishwasher and a balancing system while the dishwasher door is being closed.

Figure 4:
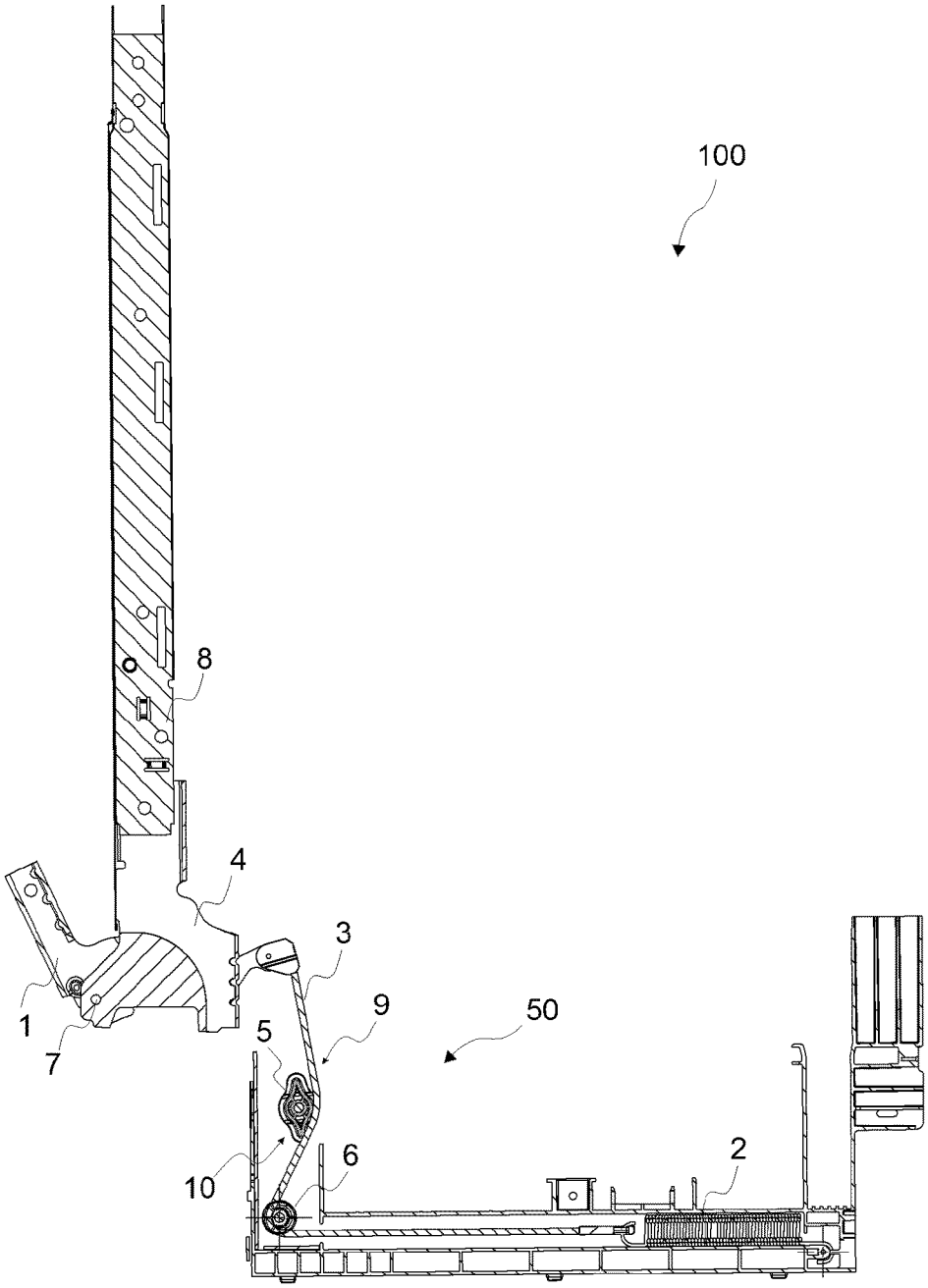

FIG. 4—is the cross-sectional view of a dishwasher and a balancing system while the dishwasher door is being opened.

Figure 5:
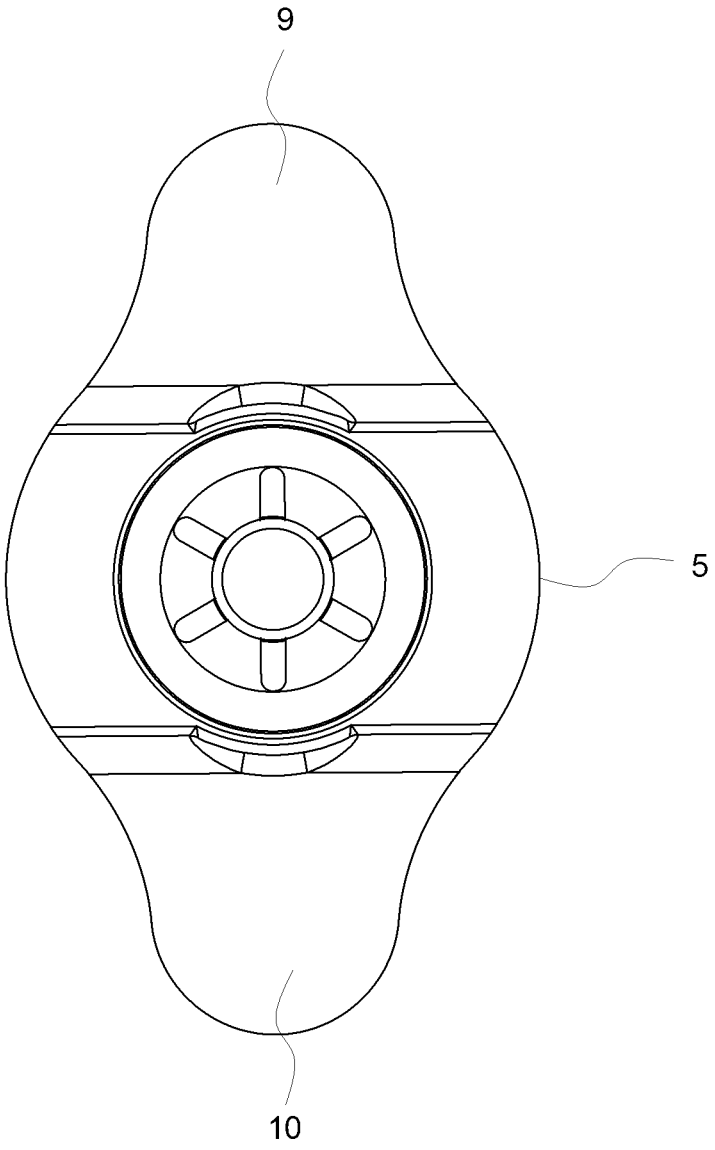

FIG. 5—is the schematic view of the first spool.

The elements illustrated in the figures are numbered as follows:

1. Hinge arm
2. Spring
3. Cable
4. Hinge plate
5. First spool
6. Second spool
7. Horizontal axis
8. Body
9. First section
10. Second section
50. Balancing system
100. Household appliance The balancing system (50) is suitable for balancing the openable-closable door of a household appliance (100), for example a dishwasher, and comprises

- a hinge plate (4) fixed to the body (8) of the household appliance (100),
- a hinge arm (1) attached to the hinge plate (4) so as to rotate around its horizontal axis (7) and whereon the openable-closable door is mounted,
- a spring (2), one end of which is fixed to the body (8) and which exerts force on the door in the direction of closing,
- a cable (3), one end of which is connected to the hinge arm (1) and the other end to the free end of the spring (2), transferring force from the spring (2) to the hinge arm (1),
- a first spool (5) that is fixed to the hinge plate (4) or to the body (8) of the household appliance (100) so as to rotate around its axis, that supports and directs the cable (3) running thereover during opening and closing of the door and that has two separate sections (9, 10) formed in different sizes and/or from different materials that rub against the cable (3) (FIG. 2 to FIG. 5).

The first spool (5) can be produced from a material like self-lubricant polyoxymethylene or can be produced from any other plastic material as well.

The respective components of the balancing system (50) and their positions for the closed state of the household appliance (100) door are shown in FIG. 1. If the door is opened in this position, the spool (5) rotates some amount counterclockwise until contacting the cable (3) from the lower side and then continues rubbing against the cable (3) (FIG. 2, FIG. 4). In the situation the door is closed from the same position, the first spool (5) this time rotates some amount clockwise until contacting the cable (3) from the upper side and then continues rubbing against the cable (3) (FIG. 3). The first spool (5) rotates a certain amount during the first movement of the door and afterwards becomes stationary. Even if the balancing force is low while the cable (3) rotates the first spool (5) by means of friction, the door is enabled to be balanced at the desired positions since the first spool (5) becomes stationary at subsequent angles.

In an embodiment of the present invention, the sections (9, 10) form the opposite parts of the first spool (5) that extend towards the upper side and lower side of the household appliance (100) body (8) (FIG. 5).

In an embodiment of the present invention, the sections (9, 10) of the first spool (5) are produced from materials having different coefficients of friction (FIG. 5). Moreover, the lengths of the sections (9, 10) that rub against the cable (3) are equal (FIG. 5).

In an embodiment of the present invention, in the assembled state of the balancing system (50) shown in FIG. 2 to FIG. 5, the coefficient of friction of the material forming the first section (9) rubbing against the cable (3) that extends towards the hinge arm (1) is lower than the coefficient of friction of the material forming the second section (10) rubbing against the cable (3) extending towards the spring (2). Thus, the wooden weights are enabled to be balanced in built-in household appliances (100) and the door is enabled to stop at any position while being opened. Furthermore, it becomes possible to easily close the door of the household appliance (100).

In another embodiment of the present invention, the sections (9, 10) of the first spool (5) are produced from materials having equal coefficients of friction and the lengths of the sections (9, 10) rubbing against the cable (3) are different.

In another embodiment of the present invention, in the assembled state of the balancing system (50), the length of the first section (9) rubbing against the cable (3) extending towards the hinge arm (1) is shorter than the length of the second section (10) rubbing against the cable (3) extending towards the spring (2). Thus, similarly the wooden weights are enabled to be balanced in built-in household appliances (100) and the door is enabled to stop at any position while being opened. Furthermore, it becomes possible to easily close the door of the household appliance (100).

In yet another embodiment of the present invention, in the assembled state of the balancing system (50), the distance between the rotational axis of the first spool (5) and the first section (9) rubbing against the cable (3) extending towards the hinge arm (1) is less than the distance between the rotational axis of the first spool (5) and the second section (10) rubbing against the cable (3) extending towards the spring (2).

In an embodiment of the present invention, the sections (9, 10) of the first spool (5) form a single piece structure (FIG. 5).

In an embodiment of the present invention, the balancing system (50) comprises a stopper, not shown in the figures, that limits the rotational movement of the first spool (5) to a predetermined angular interval. In this embodiment of the present invention, the first spool (5) is preferably circular. Alternatively, the first spool (5) has an asymmetrical shape.

In another embodiment of the present invention, the first spool (5) preferably has a rhombus shape with rounded corners (FIG. 5). In this embodiment of the present invention, it is not necessary to use the stopper that limits the rotational movement of the first spool (5) to an angular interval (FIG. 5). In another embodiment of the present invention, the first spool (5) is elliptical.

In an embodiment of the present invention, the balancing system (50) furthermore comprises a second circular spool (6) (FIG. 2 to FIG. 5). The second spool (6) is disposed at a position on the line the cable (3) extends between the spring (2) and the first spool (5) (FIG. 2 to FIG. 5). The second spool (6) is fixed to the hinge plate (4) or the body (8) of the household appliance (100) so as to rotate 360 degrees around its axis (FIG. 2 to FIG. 5). The second spool (6) serves to support and direct the cable (3) running thereover during closing and opening of the door (FIG. 2 to FIG. 5). The cable (3), one end of which is attached to the hinge arm (1), is mounted by being run over the circular second spool (6) that rotates around a single axis and fixed to the hinge plate (4) (FIG. 2 to FIG. 5).

In an embodiment of the present invention, the dishwasher comprises a balancing system (50) of the present invention as described above (FIG. 1). Thus, it becomes possible to balance the wooden piece mounted by the customer to the built-in dishwashers. The balancing system (50) of the present invention can be used both in dishwashers and in other household appliances (100) or pieces of furniture comprising a door that can be opened/closed by rotating around a horizontal axis.

By means of the present invention, a balancing system (50) of simple configuration, that prevents the door from falling abruptly with the effect of its weight while opening, that enables the door to stop at the desired position and to be closed easily by applying different friction forces during opening and closing of the door, and a household appliance (100) wherein the said balancing system (50) is used are realized.

The invention claimed is:

1. A balancing system (50) that balances a door of a household appliance (100) that is openable and closable, and comprising a hinge plate (4) fixed to a body (8) of the household appliance (100), a hinge arm (1) attached to the hinge plate (4) so as to rotate around a horizontal axis (7) of the hinge arm (1) and whereon the door is mounted, a spring (2), one end of which is fixed to the body (8) of the household appliance (100) and which exerts force on the door in the direction of closing, a cable (3), one end of which is connected to the hinge arm (1) and the other end to a free end of the spring (2), transferring force from the spring (2) to the hinge arm (1), characterized in that a first spool (5) that is fixed to the hinge plate (4) or to the body (8) of the household appliance (100) so as to rotate around a rotational axis of the first spool (5), that supports and directs the cable (3) running thereover during opening and closing of the door and that has two separate sections (9, 10) formed in different sizes or from different materials that rub against the cable (3) such that the cable (3) is run over a first section (9) of the two separate sections (9, 10) without running over a second section of the two separate sections (9, 10) during the closing of the door and the cable (3) is run over the second section (10) without running over the first section (9) during the opening of the door.

2. A balancing system (50) as in claim 1, characterized in that the two separate sections (9, 10) of the first spool (5) form opposite parts of the first spool (5) and extend towards an upper side and a lower side of the household appliance (100) body (8), respectively.

3. A balancing system (50) as in claim 2, characterized in that the separate sections (9, 10) are produced from materials with different coefficients of friction and with equal lengths that rub against the cable (3).

4. A balancing system (50) as in claim 3, characterized in that a first coefficient of friction of a first material forming a first section (9) of the two separate sections (9, 10) and rubbing against the cable (3) that extends towards the hinge arm (1) is lower than a second coefficient of friction of a second material forming a second section (10) of the two separate sections (9, 10) and rubbing against the cable (3) extending towards the spring (2).

5. A balancing system (50) as in claim 2, characterized in that the two separate sections (9, 10) are produced from materials with equal coefficients of friction and with different lengths that rub against the cable (3).

6. A balancing system (50) as in claim 5, characterized in that a first length of a first section (9) of the two separate sections (9, 10) rubbing against the cable (3) extending towards the hinge arm (1) is shorter than a second length of a second section (10) of the two separate sections (9, 10) rubbing against the cable (3) extending towards the spring (2).

7. A balancing system (50) as in claim 5, characterized in that a first distance between the rotational axis of the first spool (5) and a first section (9) of the two separate sections (9, 10) rubbing against the cable (3) extending towards the hinge arm (1) is less than a second distance between the rotational axis of the first spool (5) and a second section (10) of the two separate sections (9, 10) rubbing against the cable (3) extending towards the spring (2).

8. A balancing system (50) as in claim 1, characterized in that the two separate sections (9, 10) are produced from materials with different coefficients of friction and have equal lengths that rub against the cable (3).

9. A balancing system (50) as in claim 8, characterized in that a first coefficient of friction of a first material forming a first section (9) of the two separate sections (9, 10) and rubbing against the cable (3) that extends towards the hinge arm (1) is lower than a second coefficient of friction of a second material forming a second section (10) of the two separate sections (9, 10) and rubbing against the cable (3) extending towards the spring (2).

10. A balancing system (50) as in claim 1, characterized in that the two separate sections (9, 10) are produced from materials with equal coefficients of friction and have different lengths that rub against the cable (3).

11. A balancing system (50) as in claim 10, characterized in that a first length of first section (9) of the two separate sections (9, 10) rubbing against the cable (3) extending towards the hinge arm (1) is shorter than a second length of a second section (10) of the two separate sections (9, 10) rubbing against the cable (3) extending towards the spring (2).

12. A balancing system (50) as in claim 10, characterized in that a first distance between the rotational axis of the first spool (5) and a first section (9) of the two separate sections (9, 10) rubbing against the cable (3) extending towards the hinge arm (1) is less than a second distance between the rotational axis of the first spool (5) and a second section (10) of the two separate sections (9, 10) rubbing against the cable (3) extending towards the spring (2).

13. A balancing system (50) as in claim 1, characterized in that the two separate sections (9, 10) form a single piece structure.

14. A balancing system (50) as in claim 1, characterized in that a stopper limits rotational movement of the first spool (5) around the rotational axis to a predetermined angular interval.

15. A balancing system (50) as in claim 1, characterized in the two separate sections (9, 10) each comprises a rounded protrusion extending in opposite directions.

16. A balancing system (50) as in claim 1, characterized in that the first spool (5) is substantially shaped as a rhombus having rounded corners.

17. A balancing system (50) as in claim 1, characterized in that a second spool (6) is disposed at a position on a line of the cable (3) that extends between the spring (2) and the first spool (5), that is fixed to the hinge plate (4) or to the body (8) of the household appliance (100) so as to rotate around a second rotational axis of the second spool (6) and that supports and directs the cable (3) running thereover during opening and closing of the door.

18. A dishwasher characterized in that the dishwasher comprises a balancing system (10) as in claim 1.

* * * * *